United States Patent [19]

Newman et al.

[11] Patent Number: 4,756,132

[45] Date of Patent: Jul. 12, 1988

[54] EXTERNAL VENEER CAP FOR AN EXISTING WALL FRAMING SYSTEM AND METHOD OF INSTALLATION

[75] Inventors: George E. Newman; Hugo J. Palacios; Jerry C. Hogan, all of Houston, Tex.

[73] Assignee: Systems Q/C, Inc., Houston, Tex.

[21] Appl. No.: 39,658

[22] Filed: Apr. 16, 1987

[51] Int. Cl.[4] ..... E04B 2/88

[52] U.S. Cl. ..... 52/235; 52/469; 52/665; 52/741

[58] Field of Search ..... 52/235, 464, 469, 461, 52/463, 665, 14, 15, 90, 86, 418, 419, 420, 741, 747, 746; 47/17

[56] References Cited

U.S. PATENT DOCUMENTS

| | | | |
|---|---|---|---|
| 2,858,916 | 11/1958 | Josephs | 52/90 |
| 2,866,527 | 12/1958 | Schilling | 52/463 |
| 2,949,981 | 8/1960 | Ferrel | 52/463 |
| 3,102,612 | 9/1963 | Dunnington | 52/464 |
| 3,118,252 | 1/1964 | Weed | 52/420 |
| 3,127,639 | 4/1964 | Hammitt | 52/464 |
| 3,488,906 | 1/1970 | Brooks | 52/464 |
| 3,956,863 | 5/1976 | Tiedeken | 52/399 |
| 3,982,360 | 9/1976 | Newman | 52/90 |
| 4,068,437 | 1/1978 | Byxbe | 52/464 |
| 4,070,806 | 1/1978 | Hubbard | 52/463 |
| 4,418,506 | 12/1983 | Weber | 52/235 |
| 4,584,804 | 4/1986 | Tajima | 52/235 |
| 4,598,520 | 7/1986 | Ellstrom | 52/456 |

FOREIGN PATENT DOCUMENTS

| | | | |
|---|---|---|---|
| 2024908 | 1/1980 | United Kingdom | 52/235 |

*Primary Examiner*—John E. Murtagh

*Attorney, Agent, or Firm*—Gunn, Lee & Jackson

[57] ABSTRACT

Disclosed is a wall system having vertical and horizontal panel gripping members connecting a plurality of panel members. The vertical and horizontal panel gripping members are covered by a veneer cap extending over the vertical and horizontal panel gripping members and being bonded to the panel members providing a panel-to-panel seal about the panel gripping members on the exterior of the wall system.

8 Claims, 3 Drawing Sheets

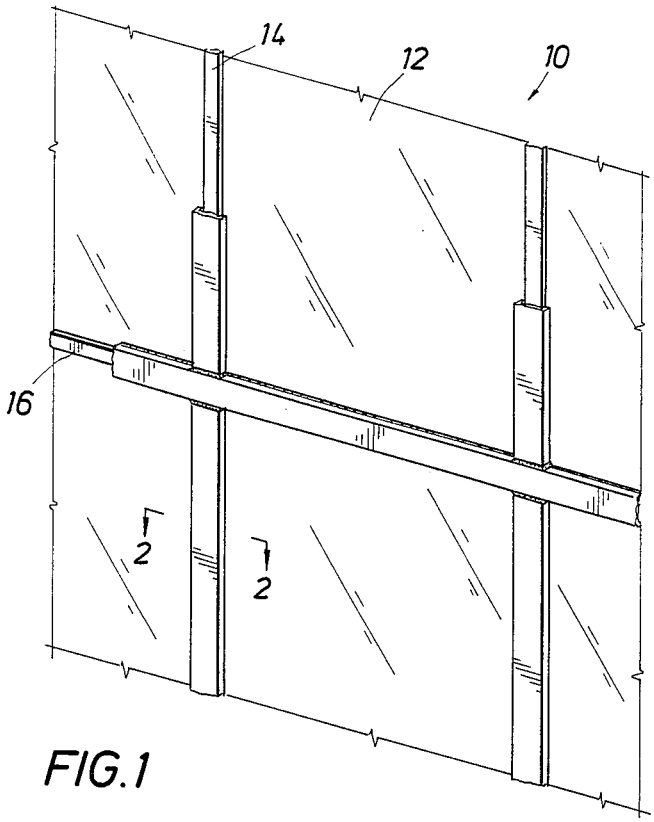
FIG. 1
FIG. 3
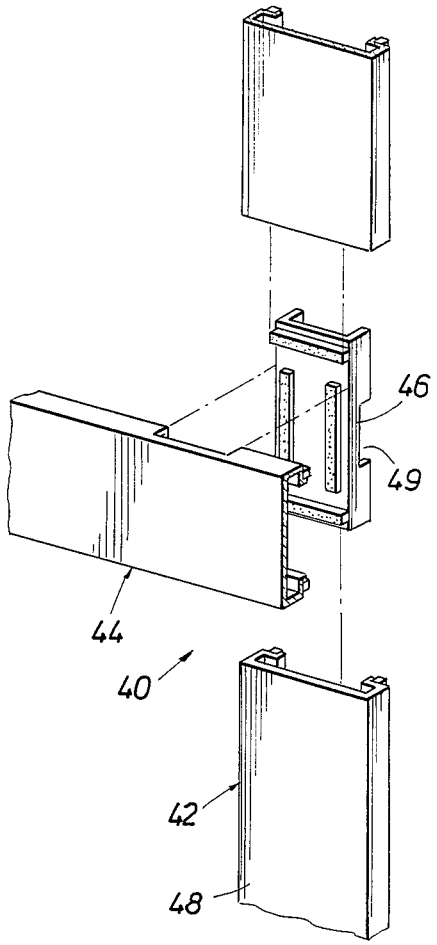
FIG. 2
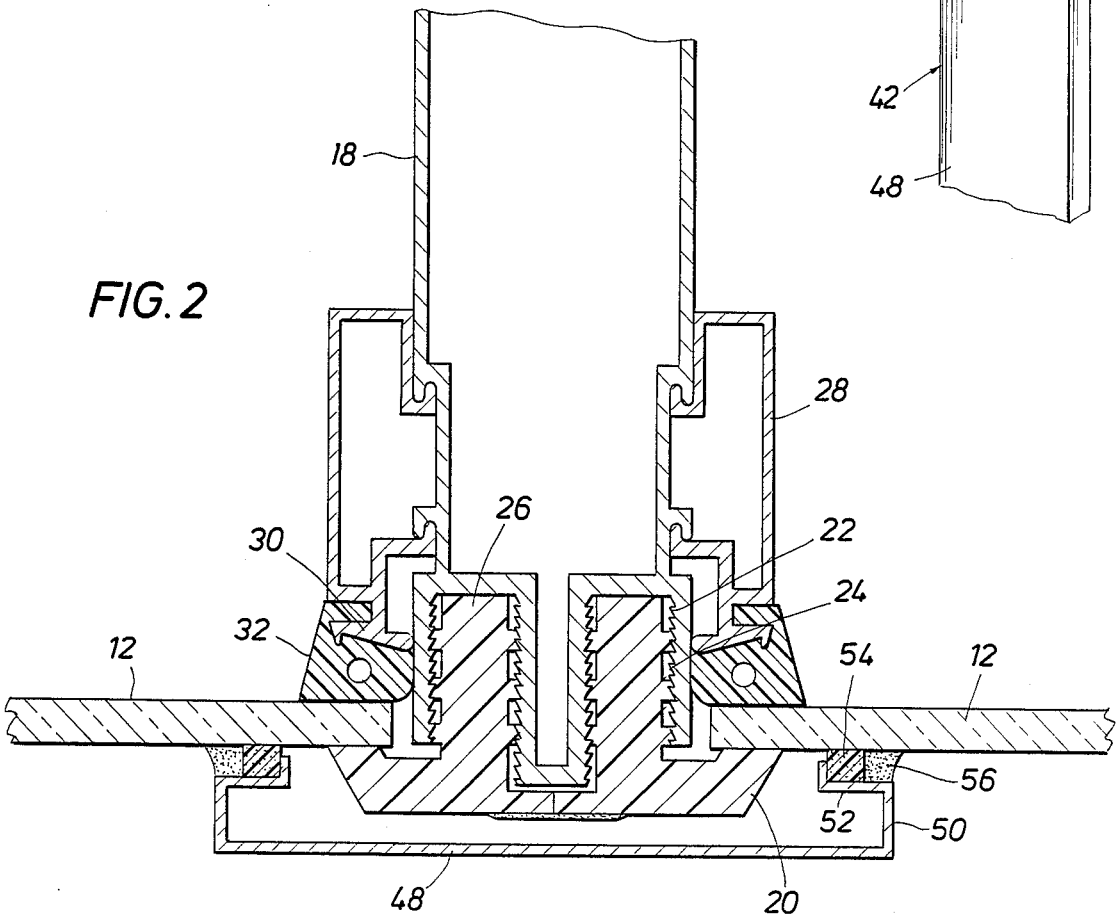

54
12
64
50
54
62
20
52
56
40
60

12
72
50
54
68
20
40
70
56
60

EXTERNAL VENEER CAP FOR AN EXISTING WALL FRAMING SYSTEM AND METHOD OF INSTALLATION

BACKGROUND OF THE DISCLOSURE

The present invention is directed to an improved wall framing system, particularly, to an external veneer cap mounted to an existing wall system of a building and the method of installation of the veneer cap.

Wall framing systems for buildings have been used for some time. In such systems, structural members such as sills, jambs, and mullions grip the edges of glass panels or the like to form the wall system. Such a wall system, for example, may be of the curtain wall, skylight, or slopped glazing type. Typically, the wall framing members include two primary parts, an interior part and an exterior part. The glass panels are captured between the interior and exterior frame members to form the completed system. The interior and exterior frame members are connected together by various means for securely gripping the glass panels. Seals or gaskets are typically installed along the connection, thereby forming a watertight seal between the wall frame members and the glass panels.

A common problem encountered with most, if not all, wall systems is intrusion of water and air past the gasket seals or other type of connection and into the building interior. Rain water, condensation, and water from window washing are the typical sources of water intruding into the wall framing system. Most buildings encounter this problem. After a period of time, the panel gasket seals become brittle and crack. The gasket seals may also be abraded by particles in the air or by routine maintenance, such as window washing. Consequently, most a relatively short period of time, most building wall systems require extensive maintenance to repair the panel gasket seals, which maintenance may include the replacement or recaulking of the panel gasket seals.

A significant problem associated with maintenance of the panel gasket seals is that repairs must often be made both from the interior and exterior of the wall system. This is always objectionable to the occupants of the building which are inconvenienced by the interruption in their work schedule.

It is, therefore, an object of the present disclosure to provide an external wall maintenance system which is watertight.

It is a further object of the invention is to provide an external wall maintenance system which may be completely installed from the exterior of the building.

It is yet another object of the invention to provide a method of installing the wall maintenance system.

SUMMARY OF THE INVENTION

The invention of the present disclosure is directed to a veneer cap installed on the external surface of a wall system and the method of installation. The veneer cap of the invention comprises a series of both vertical and horizontal members which bridge the existing system mullion, sill and jamb connections thereby providing a panel-to-panel seal over the panel gasket seals of the wall system. The veneer cap includes a bridging member having a pair of parallel, spaced legs extending therefrom. The legs terminate at flange members which extend substantially perpendicular to the leg members. A double sides adhesive tape initially secures the veneer cap to the external surface of the wall system over the panel gasket junction. A structural silicone adhesive sealant permanently bonds the veneer cap to the external surface of the wall system.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are, therefore, not to be considered limiting of its scope, for the invention may admit to other equally effective embodiments.

FIG. 1 is a perspective view of a portion of a wall system having the veneer cap of the invention mounted thereon;

FIG. 2 is a sectional view showing the veneer cap of the invention bridging over the panel connection of the wall system;

FIG. 3 is a partial, exploded view showing the vertical and horizontal components forming the veneer cap of the invention;

DETAILED DESCRIPTION OF THE PREFERRED EMBODIMENT

Figure 5:
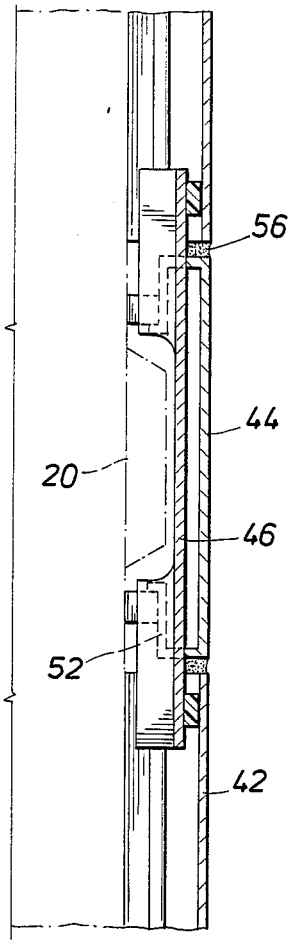
FIG. 5 is a sectional view taken along line 5—5 of FIG. 4.

Referring first to FIG. 1, a portion of an existing wall system of a building is shown and generally designated by the numeral 10. The wall system 10 includes a series of glass panels 12 connected by mullions 14 and sills 16. As best shown in FIG. 2, the mullion 14 of the wall system 10 is of typical construction known in the prior art. The mullion 14 includes an interior metal connector 18 and an external connector seal 20. The forward end of the metal connector 18 is provided with a pair of channels 22 which extend the full length of the metal connector 18. The walls of the channels 22 are provided with serrations or teeth 24 for gripping a pair of legs 26 which project from the bottom surface of the external connector seal 20 and are received within the channels 22. The metal connector 18 is also provided with connector clips 28 which fasten thereon. The connector clips 28 include gripping flanges 30 which secure an internal seal 32 against the interior edges of the glass panels 12. The sill 16 is of similar construction for gripping the horizontal edges of the glass panels 12 as shown in FIG. 1. It will be observed that the glass panels 12 of the wall system 10 shown in FIGS. 1 and 2 are gripped between an interior and exterior member which are joined together and grip the panels 12 along the edges thereof. The wall system 10 is typical of many wall systems on existing buildings.

Referring again to FIG. 2, it is readily apparent that water intrusion into the building is highly likely along the external connector seal 20 and the internal seal 32. Climatic conditions and any number of other factors may quickly weaken the seal structure of the wall system 10 permitting intrusion of water and/or air. Prior to the present disclosure, costly repairs and business disruptions were required to remedy such a problem.

Referring now to FIG. 3, the veneer cap of the invention is generally identified by the numeral 40. The veneer cap 40 comprises a series of vertical members 42 and horizontal members 44. The veneer cap members 42 and 44 are fabricated of extruded aluminum and may be cut to any desired length as required for a particular wall system. Aluminum is a lightweight material and particularly suited for this purpose, however, the veneer cap 40 of the invention may be fabricated of any material suitable for external wall systems. For example, extruded plastic or vinyl is well suited for this purpose.

The veneer cap 40 is mounted to the external surface of the wall system 10 and is secured directly to the panels 12. The mullion, sill and jamb structures and the seals associated therewith are not affected or altered during the installation of the veneer cap 40. The intersection of vertical and horizontal external connector seals 20 is bridged over by a channel splice 46 which will be described in greater detail hereinafter.

Returning again to FIG. 2, it will be observed that the vertical veneer cap member 42 defines a substantially channel-like configuration formed by a cover plate 48 and a pair of spaced, parallel leg members 50 extending therefrom. The leg members 50 terminate in L-shaped flanges 52 which extend inwardly from the leg members 50 and are substantially parallel to the cover plate 48.

The veneer cap 40 is initially secured to the panels 12 by a double sided adhesive tape 54. The tape 54 has some thickness and for purposes of illustration, may be approximately 3/16 inch by ¼ inch. Thus, upon securing the veneer cap 40 to the panels 12, a gap of approximately 3/16 of an inch is defined between the surface of the panels 12 and the flanges 52 of the veneer cap 40. The gap is filled with structural silicon 56. The consistency of the silicon 56 is much like that of caulk used in weather stripping and therefore it does not tend to run. The silicone 56 is smoothed out to present a clean appearance. The cure time for the structural silicon 56 may vary depending on the type used. The cure time for Dow Cornig 795 silicone, which has been found to be particularly suitable for this purpose, is approximately 21 days. Once the silicon 56 has cured, a permanent and waterproof panel-to-panel seal is formed about the external connector seal 20.

For purposes of illustration only, the veneer cap 40 is shown as having a substantially U-shaped channel-like configuration. It is understood, however, that the shape of the veneer cap 40 is not particularly significant and may be any shape which will bridge over the external connector seal 20 or external connecting member of the wall structure to provide a panel-to-panel seal. The profile of the vertical veneer cap member 42 and horizontal veneer cap member 44 is substantially the same, however, the horizontal veneer cap member 44 is slotted to receive the channel splice 46 as shown in FIG. 3.

Figure 4:
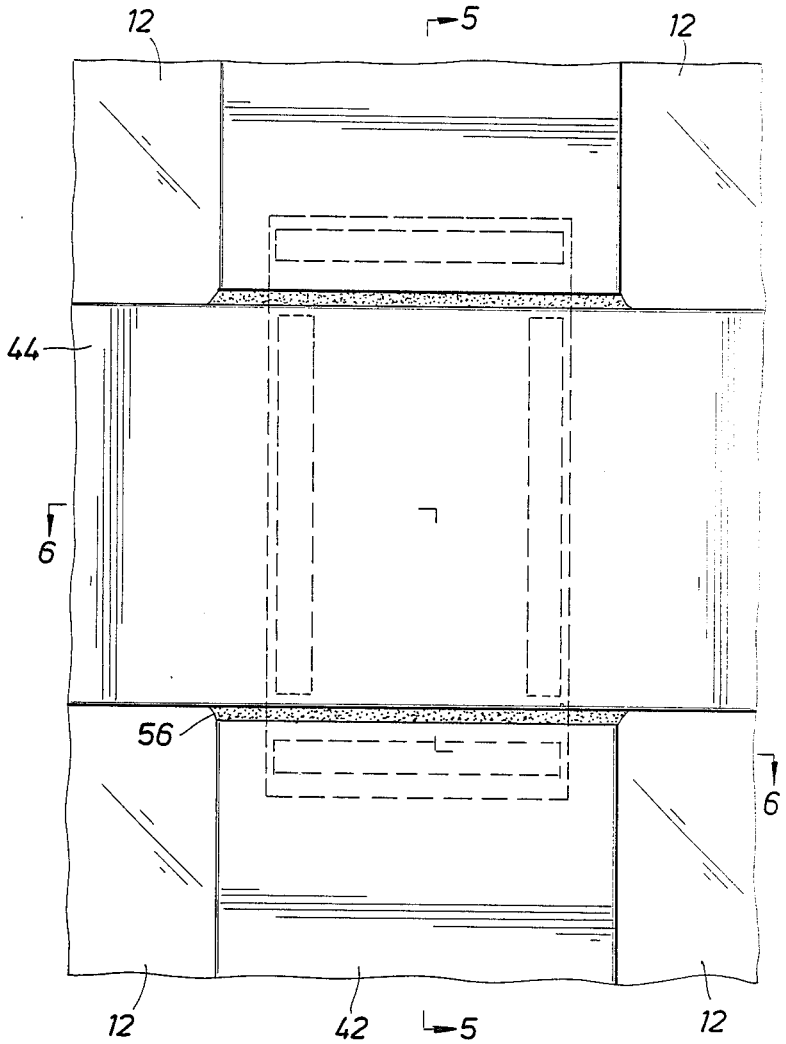
FIG. 4 is an enlarged plan view showing the junction of the vertical and horizontal components of the veneer cap of the invention.
Figure 6:
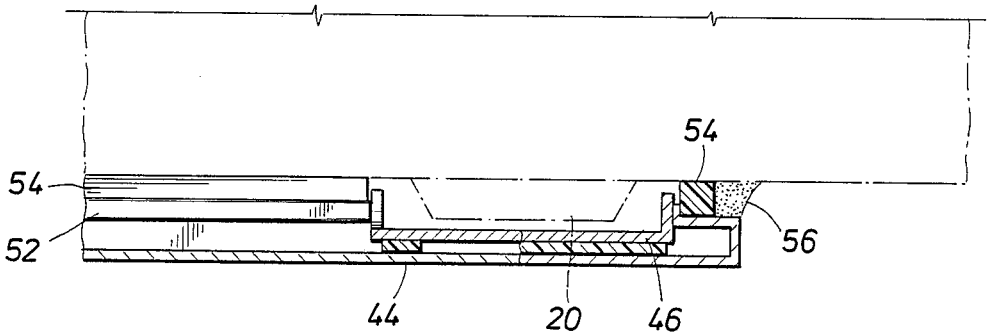
FIG. 6 is a sectional view taken along line 6—6 of FIG. 4.

Referring now collectively to FIGS. 4, 5 and 6, the junction of the vertical cap member 42 and the horizontal cap member 44 is shown. To bridge the external connector seal 20 at a four corner junction, the channel splice 46 is adhesively mounted to the horizontal veneer cap member 44. The member 44 is measured and slotted so that the channel splice 46 may be centered over the vertical external connector seal 20. Likewise, the channel splice 46 includes a slot 49 which bridges over the horizontally extending external connector seal 20. The channel splice 46 is substantially U-shaped in profile having a longitudinal length slightly greater than the width of the horizontal veneer cap member 44 so that each end of the channel splice 46 projects outwardly from the member 44 when it is adhesively mounted thereto as shown in FIG. 5. The channel splice 46 is dimensioned so that the projecting ends thereof fit snugly within the channel formed by the vertical veneer cap member 42. The projecting ends of the channel splice 46 are wrapped with bond breaker tape and the vertical veneer cap member 42 is slid about the projecting ends of the channel splice 46 and aligned with the horizontal veneer cap member 44 and slightly spaced therefrom. Thus, a gap 43 is defined between the end of the vertical veneer cap member 42 and a side leg member of the horizontal veneer cap member 44 as shown in FIGS. 4 and 5. The gap 43 is filled with the silicone 56, thereby forming a seal at the junction of the veneer cap sealant members 42 and 44 which extends from one panel 12 across the top of the channel splice 46 to the opposite panel 12. In this manner, a seal is provided between the channel splice 46, the vertical veneer cap member 42 and the horizontal veneer cap member 44, thereby completely sealing about the four corner junction.

Figure 7:
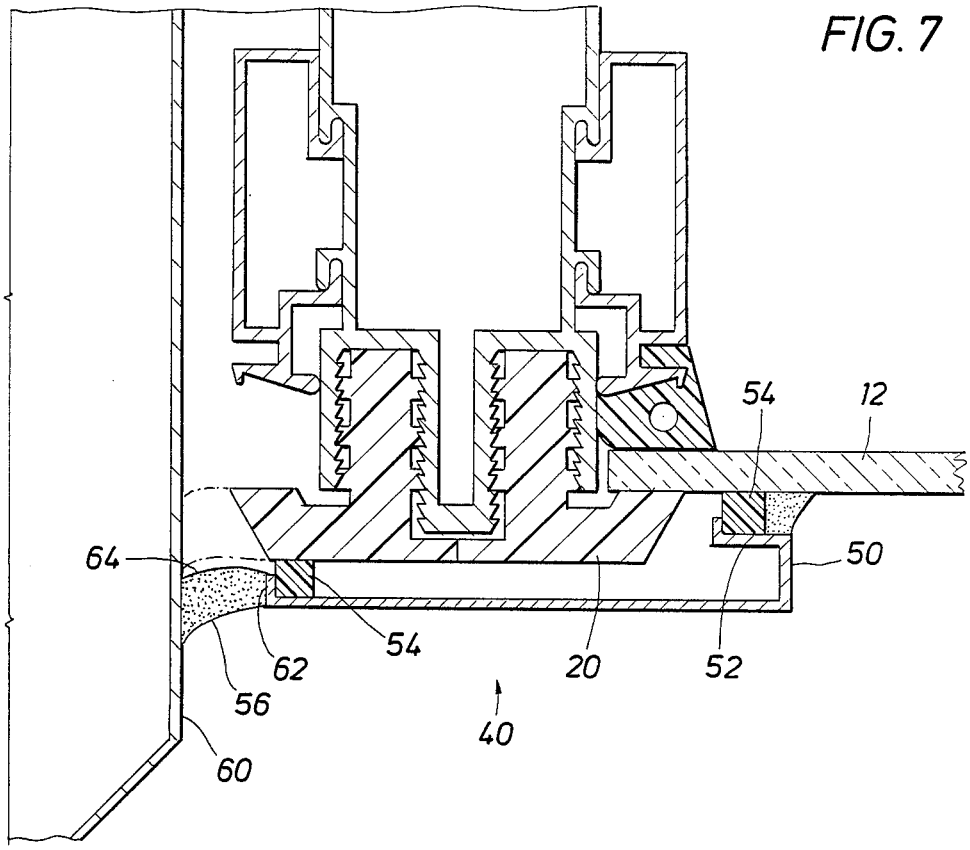
FIG. 7 is a sectional view of an alternate embodiment of the veneer cap of the invention.
Figure 8:
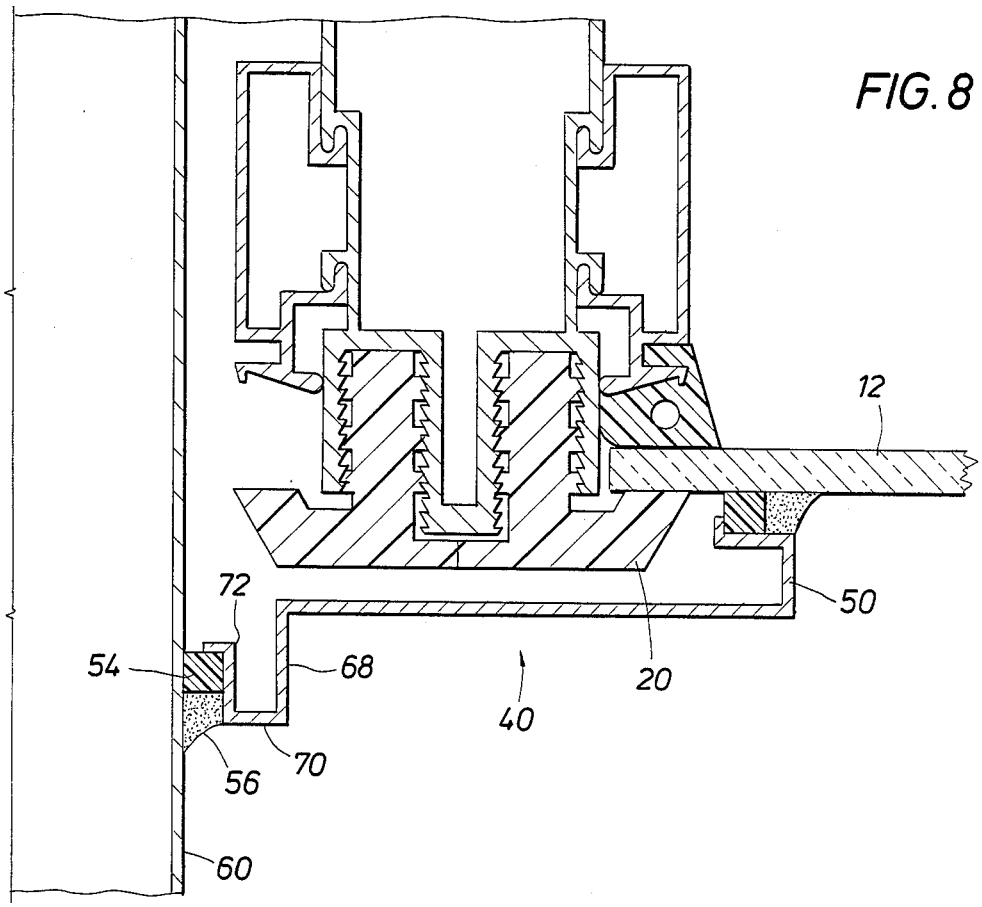
FIG. 8 is a sectional view of yet another alternate embodiment of the veneer cap of the invention.

Referring now to FIGS. 7 and 8, alternate embodiments of the veneer cap 40 are shown. In the embodiment of FIG. 7, the veneer cap 40 has been modified to provide a bridging seal between a panel 12 and a wall member 60. The veneer cap 40 is modified along one longitudinal end to include a flange 62 extending inwardly and substantially parallel to the leg member 50. The adhesive tape 54 is positioned interiorly of the flange 62 and adhesively mounts an edge of the cover plate 48 adjacent to the flange 62 and to the top face of the external connector seal 20. A bond breaker tape 64 extends from the flange 62 to the wall 60 to cover the gasket seal of the wall system. The gap formed between the flange 62 and wall 60 is filled with the silicone sealant 56 in the same manner as previously described.

The alternate embodiment of FIG. 8 is substantially similar to the embodiment shown in FIG. 7. However, the veneer cap 40 has been modified to include a leg member 68 which extends outwardly from the cover plate 48 in a direction opposite the leg member 50. A cross member 70 connects the leg member 68 to a flange 72. The flange 72 provides a surface for adhesively mounting the veneer cap 40 to the wall 60. The gap defined therebetween is filled with silicone sealant 56 to complete the installation of the veneer cap 40 bridging between the plate 12 and the wall 60.

The veneer cap 40 of the invention may be installed on most existing wall systems. The veneer cap 40 is installed from the exterior of the building and therefore does not interrupt the daily routine of the building occupants. Prior to installation, the panels 12 are cleaned thoroughly along the area adjacent the external connector seal 20. The external connector seal 20 is also wiped clean with a solvent so that all contact areas are clean. If not already prepared, the horizontal veneer cap member 44 is cut to length and slotted to receive the channel splice 46. The channel splice 46 then is adhesively mounted to the horizontal veneer cap member 44 in the slotted area. The veneer cap member 44 is then aligned to bridge over a horizontal external connector seal 20 of the wall system 10. Backing tape on the adhesive tape 54 is removed and the horizontal veneer cap member 44 is pressed against the panels 12. The process is repeated to secure the horizontal veneer cap member 44 to the panels 12 until all the horizontal veneer cap members 44 to be installed are adhesively secured to the panels 12.

The vertical veneer cap members 42 are prepared in a similar fashion. Each vertical veneer cap member 42 is first tested to insure that there is a proper fit about the projecting ends of the channel splice 46. The vertical veneer cap member 42 is then aligned and the tape backing is removed from the tape 54 permitting the vertical veneer cap member 42 to be adhesively mounted to the panels 12. After installation of the vertical veneer cap members 42 is completed, the silicone sealant 56 is applied and smoothed to complete the installation.

While the foregoing is directed to the preferred embodiments of the present invention, other and further embodiments of the invention may be devised without departing from the basic scope thereof, and the scope thereof is determined by the claims which follow.

What is claimed is:

1. A veneer cap for installation on an existing wall system, comprising:

(a) a horizontal veneer cap member formed by a horizontal cover plate having spaced, parallel leg members extending inwardly along opposed longitudinal edges of said horizontal cover plate, said horizontal cover plate and said leg members defining a cavity therebetween;

(b) a vertical veneer cap member formed by a vertical cover plate having a pair of leg members extending inwardly along opposed longitudinal edges of said vertical cover plate, said pair of leg members extending substantially perpendicular to said vertical cover plate and defining a channel cavity therewith;

(c) a channel splice member formed by a base member and a pair of spaced upstanding flange members extending from said base member; and (d) wherein said horizontal veneer cap member includes at least one slot formed across said leg members, said slot sized to receive said channel splice member and wherein said channel splice member is adhesively attached to said horizontal cover plate.

2. The apparatus of claim 1 wherein said channel splice member is greater in axial length than the width of said horizontal cover plate, said channel splice member including a slot extending across said upstanding flange members.

3. The apparatus of claim 2 wherein said channel slot is in alignment with said horizontal cover plate cavity upon mounting said channel splice to said horizontal cover plate.

4. The apparatus of claim 1 wherein said parallel leg members of said horizontal cover plate and said perpendicular leg members of said vertical cover plate include L-shaped flanges defining a contact surface for tape means and sealant for bonding said veneer cap to the wall system.

5. The apparatus of claim 4 wherein said sealant is structural silicone adhesive.

6. The apparatus of claim 5 wherein said tape means comprises a double-sided adhesive for joining said veneer cap to the wall system.

7. A method of installing a veneer cap on an existing wall system from the exterior of a building, the wall system including a plurality of glazing panels supported between interior and exterior framing members cooperatively engaging and supporting the glazing panels therebetween to form the wall system, the method comprising the steps of:

(a) cleaning the exterior framing members and the areas of the glazing panels adjacent said exterior framing members;

(b) aligning horizontal and vertical veneer cap members over the exterior framing members;

(c) mounting said horizontal and vertical veneer cap members to said glazing panels over the exterior framing members;

(d) positioning a channel splice member across said horizontal veneer cap members for connecting said vertical veneer cap members to said horizontal veneer cap members at points of intersection of said vertical and horizontal veneer cap members; and (e) placing structural silicone adhesive sealant between the glazing panels and the vertical and horizontal veneer cap members to form a panel-to-panel seal along the exterior framing members wherein said veneer cap bridges over and covers the exterior framing members of the wall system.

8. In an existing framing system including glazing panels supported between interior and exterior framing members cooperatively engaging and supporting the glazing panels therebetween, the improvement comprising a veneer cap installed on the exterior of the framing system over the exterior framing members and bonded to adjacent glazing panels providing a panel-to-panel seal along the exterior framing members and wherein said veneer cap bridges over and covers the exterior framing members, said veneer cap comprising:

(a) a horizontal veneer cap member;

(b) a vertical veneer cap member;

(c) wherein said horizontal and vertical veneer cap members intersect at least at one point of intersection providing a panel-to-panel seal over intersecting exterior framing members; and (d) a channel splice member connecting said horizontal and vertical veneer cap members at the point of intersection.

* * * * *